US012631417B2

(12) United States Patent
Shaw et al.

(10) Patent No.: US 12,631,417 B2
(45) Date of Patent: May 19, 2026

(54) FIREARM ACCESSORY MOUNTS

(71) Applicant: Shaw Armament Systems, LLC, Powder Springs, GA (US)

(72) Inventors: Bryan David Shaw, Powder Springs, GA (US); Joseph Curtis Jones, Dallas, GA (US)

(73) Assignee: Shaw Armament Systems, LLC, Powder Springs, GA (US)

( * ) Notice: Subject to any disclaimer, the term of this patent is extended or adjusted under 35 U.S.C. 154(b) by 13 days.

(21) Appl. No.: 18/410,551

(22) Filed: Jan. 11, 2024

(65) Prior Publication Data

US 2024/0240900 A1 Jul. 18, 2024

Related U.S. Application Data

(60) Provisional application No. 63/438,988, filed on Jan. 13, 2023.

(51) Int. Cl.
*F41A 21/32* (2006.01)

(52) U.S. Cl.
CPC ..... *F41A 21/325* (2013.01)

(58) Field of Classification Search
CPC ..... F41A 21/30–42
USPC ..... 89/14.05, 14.2–14.4; 181/223
See application file for complete search history.

(56) References Cited

U.S. PATENT DOCUMENTS

| | | | | |
|---|---|---|---|---|
| 6,385,891 | B1 * | 5/2002 | Rabatin | F41A 21/325 42/79 |
| 7,353,740 | B1 * | 4/2008 | Hoffman | F41A 21/325 89/14.05 |
| 8,291,805 | B1 * | 10/2012 | Quilligan | F41A 21/325 285/305 |
| 8,490,535 | B1 * | 7/2013 | Moore | F41A 21/34 42/1.06 |
| 9,513,078 | B1 * | 12/2016 | Fulton | F41A 21/325 |
| 9,921,021 | B1 * | 3/2018 | Graham, II | F41A 21/325 |
| 9,927,201 | B2 * | 3/2018 | Penchuk | F41A 21/325 |
| 10,088,261 | B1 * | 10/2018 | Oglesby | F41A 21/34 |
| 10,156,411 | B2 * | 12/2018 | Thompson | F41A 21/325 |
| 10,184,744 | B2 * | 1/2019 | Young | F41A 21/325 |
| 10,641,573 | B2 * | 5/2020 | Jen | F41A 21/325 |
| 10,670,362 | B2 * | 6/2020 | Wilson | B23K 35/0244 |
| 11,143,477 | B1 * | 10/2021 | Oglesby | F41A 21/36 |
| 11,156,423 | B2 * | 10/2021 | Winterseth | F41A 21/34 |
| 2012/0180623 | A1 * | 7/2012 | Graham, II | F41A 21/325 89/14.4 |
| 2012/0279381 | A1 * | 11/2012 | Landolt | F41A 21/30 89/14.4 |
| 2014/0020977 | A1 * | 1/2014 | Shults | F41A 21/325 181/223 |

(Continued)

*Primary Examiner* — Troy Chambers
*Assistant Examiner* — Benjamin S Gomberg
(74) *Attorney, Agent, or Firm* — Buchalter LLP

(57) ABSTRACT

A firearm accessory mounting device is disclosed, comprising a nut, a collar coupled to the nut, and a follower captured between the collar and within a cam track of the nut. When the nut is rotated relative to the collar, threaded engagement secures the nut to the collar. Once the threaded engagement causes a torque threshold to be reached, further rotation of the nut causes the follower to extend radially inward to create a compressive force on a muzzle device and quickly and stably attach the firearm accessory mounting device.

20 Claims, 11 Drawing Sheets

(56) References Cited

U.S. PATENT DOCUMENTS

| | | | | |
|---|---|---|---|---|
| 2014/0237881 | A1* | 8/2014 | Mack | F41A 21/325<br>42/90 |
| 2017/0261281 | A1* | 9/2017 | Salvador | F41A 21/325 |
| 2018/0335268 | A1* | 11/2018 | Lee | F41A 21/34 |
| 2019/0093974 | A1* | 3/2019 | Smith | F41A 21/325 |
| 2019/0353446 | A1* | 11/2019 | Kras | F41A 21/325 |
| 2023/0138685 | A1* | 5/2023 | Wilson | F41A 21/325<br>89/14.05 |
| 2024/0060742 | A1* | 2/2024 | DeJessa | F41A 21/34 |
| 2024/0077273 | A1* | 3/2024 | Kras | F41A 21/325 |

* cited by examiner

FIREARM ACCESSORY MOUNTS

CROSS-REFERENCE TO RELATED APPLICATIONS

This application claims the benefit of provisional U.S. Patent Application No. 63/438,988, filed on Jan. 13, 2023, which is incorporated herein in its entirety.

TECHNICAL FIELD

This disclosure relates to quick, secure, and reliable device attachment. More specifically, this disclosure relates to a quick attachment device for securely coupling a device to a firearm's barrel.

BACKGROUND

Systems and methods of attaching mechanical components generally fall into two broad categories: quick attach/detach and more secure and permanent attaching mechanisms. It is sometimes advantageous to have a quick attachment mechanism that is both quickly attached/detached and creates a reliable attachment, even under extreme conditions.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, a firearm accessory mounting device is disclosed, comprising a nut, a collar, and a follower substantially captured within the collar. The nut can comprise cam tracks that guide the stem of the follower from an unlocked position to a locked position.

In a further aspect, disclosed is a firearm comprising a muzzle device coupled to a firearm accessory mounting device. The firearm accessory mounting device can comprise threaded surfaces that create a joint between the muzzle device (e.g., on a barrel of a firearm) and a firearm accessory such as a can, which in some aspects can be a silencer. The firearm accessory mounting device can further comprise followers that can engage the muzzle device and can provide a redundant load path to stabilize the joint.

In yet another aspect, disclosed is a method for coupling a firearm accessory mounting device to a muzzle device of a firearm. The firearm accessory mounting device can be threadedly rotated onto threads on the outer surface of the muzzle device. When the torque of the threaded joint between the firearm accessory mounting device and the muzzle device reaches a threshold, a stem on a follower is rotatably engaged by cam tracks that force the follower radially inward to clamp on the muzzle device. In various embodiments, the steps of the method may be performed by hand and/or with the assistance of a tool (e.g., a crescent wrench).

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and, together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

Figure 1:
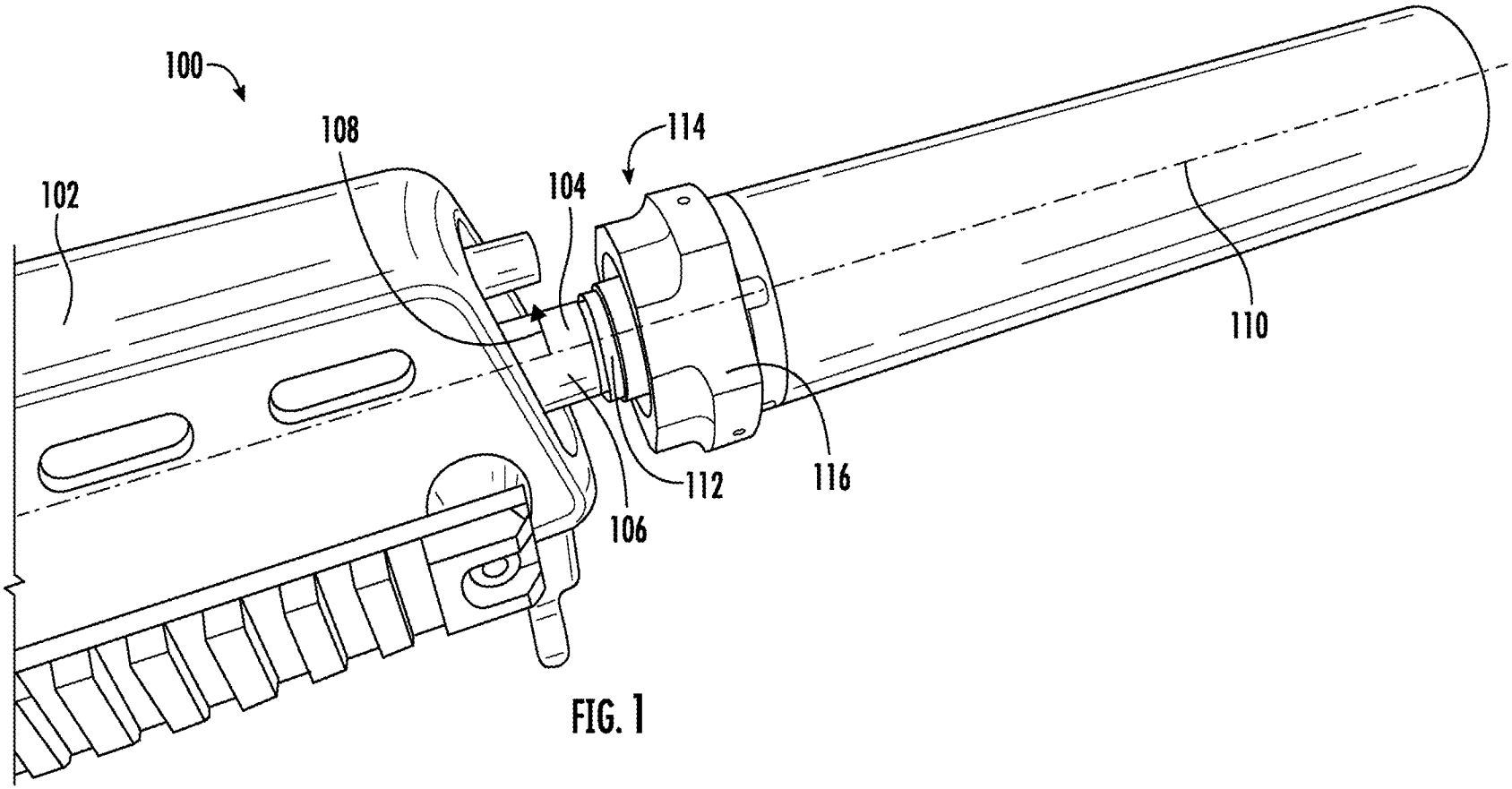
FIG. 1 is a perspective view of a completed firearm silencer assembly, in accordance with one aspect of the current disclosure.

FIG. 1 illustrates an attachment assembly 100 coupling a silencer to a firearm 102 in accordance with one aspect of the current disclosure. As described in greater detail below, the attachment assembly 100 comprises a muzzle device 112 and a firearm mounting device 208 (FIG. 2) coupled to one another and functioning to attach, e.g., a silencer to a firearm 102. The firearm 102 can comprise a barrel 104. The barrel 104 comprises an inner surface that can be threaded and/or rifled to capture and/or rotate the bullet or projectile. An outer surface 106 of the barrel 104 can be cylindrical and/or smooth, such that it is described by a radius 108 extending from a central or axial axis 110 of the barrel 104 to the outer surface 106 of the barrel 104. In some aspects, the outer surface 106 can be defined by an octagonal, or other angular, shape. A smaller radius extending from the axial axis 110 to the inner surface 205 (FIG. 2) of the barrel 104 also defines the inner surface 205 of the barrel 104 such that a thickness of the barrel 104 is the difference between the outer radius 108 and the inner radius 205.

In various aspects of the present application, it can be desirable to modify barrel 104 of firearm 102 with various modifications or attachments, e.g., with muzzle device 112. For example, attached modifications can comprise chokes (e.g., to focus the discharge of a shotgun), silencers, suppressors, a muzzle break, and/or a flash hider. As used herein, a muzzle device 112 can comprise an attached modification coupled to barrel 104 of firearm 102 and can comprise one or more chokes, silencers, suppressors, muzzle breaks, and/or flash hiders coupled to barrel 104. The attachment between barrel 104 of firearm 102 and the attachment assembly 100 creates a joint 114 that can be secured by a retention device 116. The retention device 116 can selectively be rotated from an unlocked configuration 602 (FIG. 6) to a locked configuration 1402 (FIG. 14), as described in greater detail below.

Figure 2:
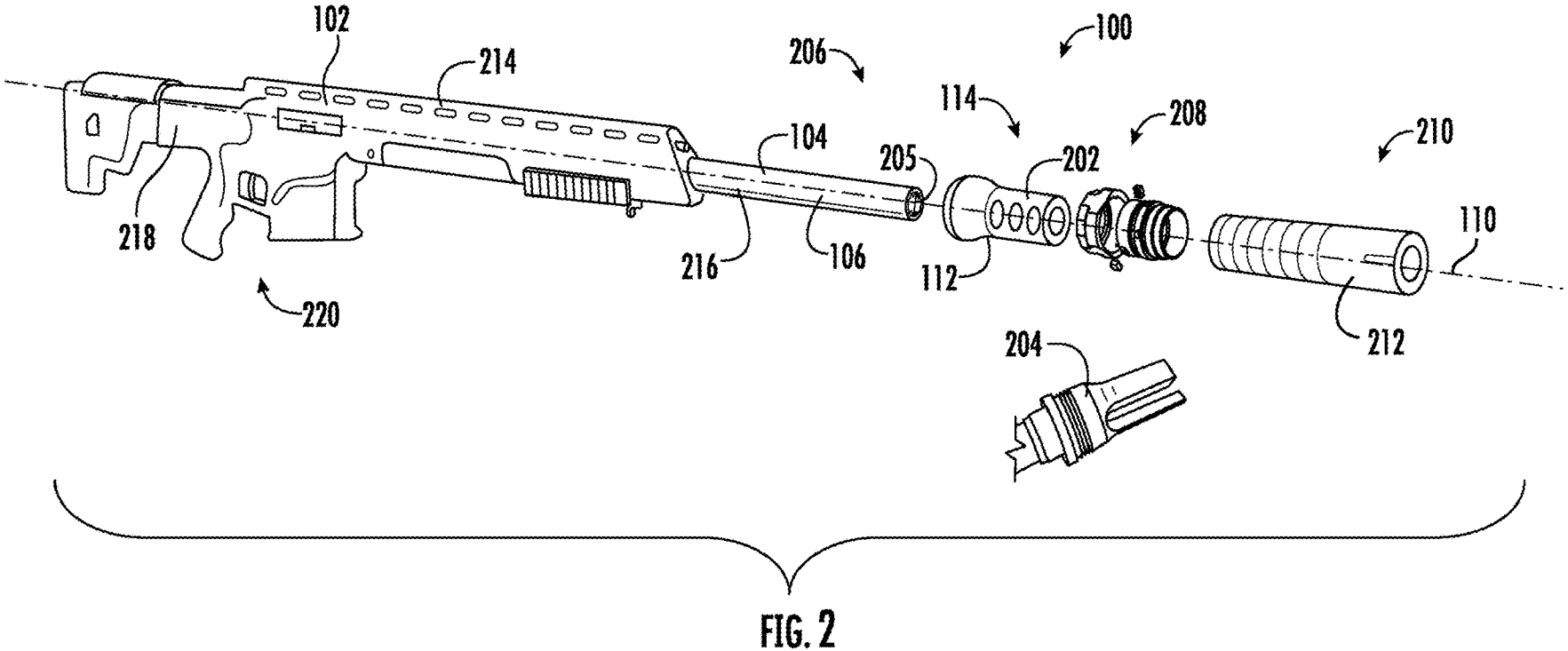
FIG. 2 is a perspective-exploded view of the completed firearm silencer assembly of FIG. 1

FIG. 2 is an exploded view of the attachment assembly 100] illustrated in FIG. 1. As illustrated in FIG. 2, the muzzle device 112 can be selected from a muzzle break 202 or a flash hider 204 and can be interposed between and/or threadedly coupled to the barrel 104 on a first or barrel side 206 and to a firearm accessory mounting device 208 on a second canister 212 or exit side 210 of the attachment assembly 100. The firearm accessory mounting device 208 can be coupled to a can or canister 212 (e.g., a silencer or suppressor). In some aspects, the firearm accessory mounting device 208 can be a chuck (i.e., a specialized type of clamp used to hold an object with radial symmetry) and can also be referred to as a rapid chuck retention device.

As illustrated in FIG. 2, firearm 214 can be the same as or similar to firearm 102 and can comprise a barrel 216 (the same as or similar to barrel 104), a stock 218, and an action 220. An operator of firearm 214 can grip stock 218 and/or hold stock 218 to operate firearm 214. Stock 218 can be configured to be held by a user or operator of firearm 214 while loading, unloading, and/or discharging firearm 214. Action 220 can comprise a trigger assembly, magazines, a break, a bolt, etc., and can be configured to facilitate the operator while loading and discharging firearm 214. Barrel 216 provides the pressurization during discharge to eject the projectile (e.g., bullet) from firearm 214. As shown in FIGS. 1 and 2, muzzle device 112 can be coupled to barrel 216 at barrel side 206 of the attachment assembly 100. Similarly, canister 212 can be coupled to exit side 210 of firearm accessory mounting device 208 of the attachment assembly 100.

Firearm accessory mounting device 208 can facilitate secure coupling and/or securing of muzzle break 202 (or flash hider 204) to canister 212. The present design of firearm accessory mounting device 208 can facilitate the rapid attachment and/or detachment of firearm accessory mounting device 208 and/or canister 212 from firearm 102. Firearm accessory mounting device 208 can also enhance the securing force generated in the joint 114 to securely couple canister 212 onto firearm 214 (or firearm 102). The firearm accessory mounting device 208 can comprise a plurality of components working together to threadedly engage firearm accessory mounting device 208 to barrel 104 and/or securely attach canister 212.

Figure 3:
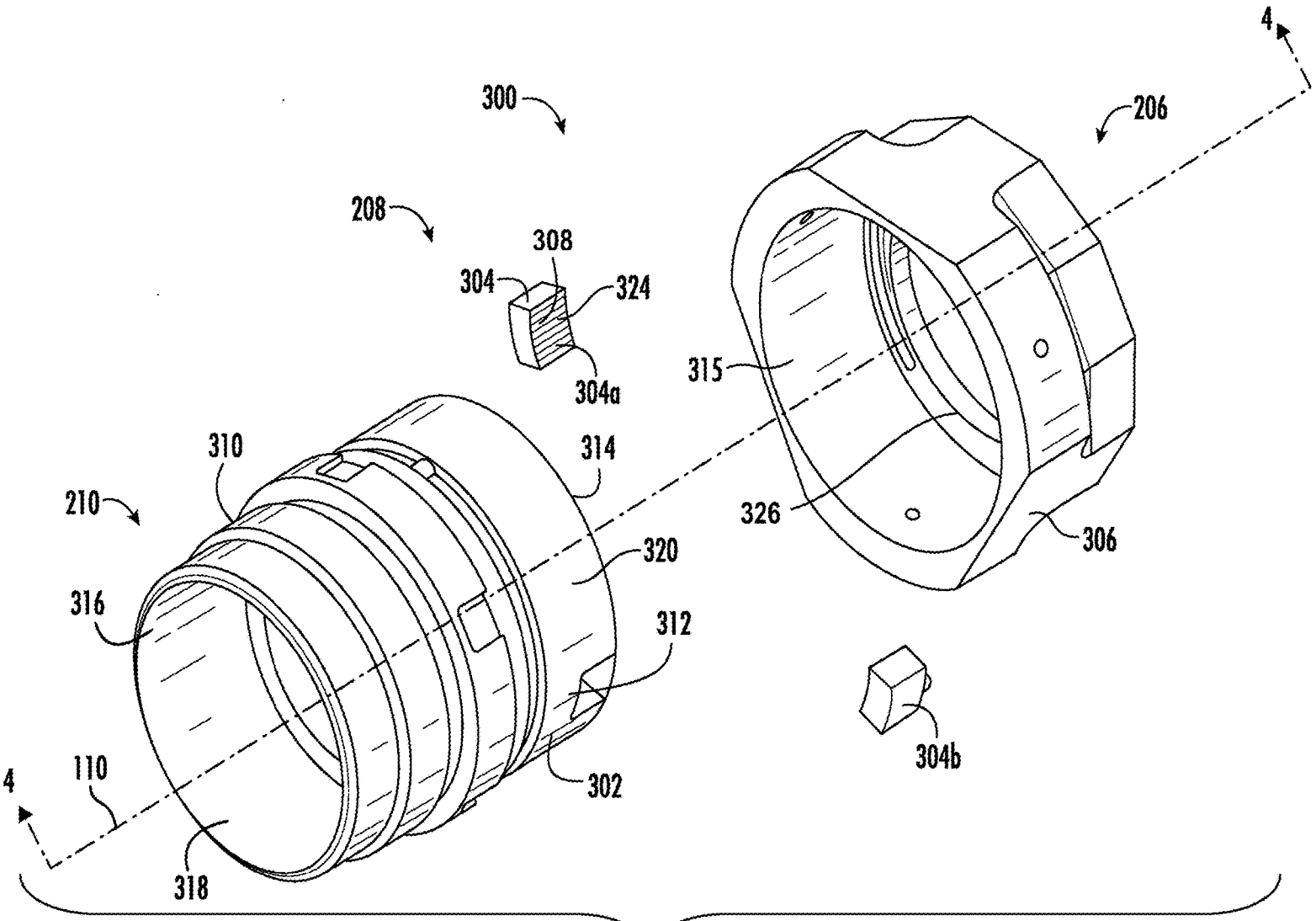
FIG. 3 is [a perspective exploded detail view of a firearm accessory mounting device of FIG. 1 taken from detail 3 of FIG. 1.

FIG. 3 illustrates the components of firearm accessory mounting device 208 in an exploded detail view. Firearm accessory mounting device 300 shown in FIG. 3 can be the same as or similar to the firearm accessory mounting device 208 described in FIGS. 1 and 2. Firearm accessory mounting device 300 can comprise a collar 302, one or more followers 304, and/or a nut 306. In the current aspect, firearm accessory mounting device 300 can comprise two followers 304*a* and 304*b*, though any number of followers 304 can be present in various aspects. When firearm accessory mounting device 300 is attached and/or secured to firearm 102, collar 302 can be oriented at the exit side 210 of firearm 102 and/or attachment assembly 100. Similarly, nut 306 can be oriented at barrel side 206 of firearm 102 and/or attachment assembly 100. Although firearm accessory mounting device 300 is shown as an assembly comprising a variety of components, it is to be understood that a consumer or operator of the firearm accessory mounting device 300 can use the firearm accessory mounting device 300 without ever disassembling the collar 302, e.g., disassembling collar 302 from nut 306 to release followers 304*a,b*. In various aspects, firearm mounting device 300 can have more than two followers, e.g., three, four, five, six, seven, eight, nine, ten, or more followers are contemplated to be captured within the collar 302 and/or nut 306. One feature of the present disclosure is that the end user/operator can modify firearm accessory mounting device 300 to a variety of different sizes and affix the firearm accessory mounting device 300 to the barrel side 206 of a firearm 102 without ever disassembling the firearm accessory mounting device 300, as illustrated in FIG. 3.

Firearm accessory mounting device 300 can be configured to provide two mechanisms to secure joint 114, such that a quick attachment can be made and/or secured sufficient to withstand repeated firing of firearm 102 (or firearm 214). First, barrel 104 threadedly couples to an outer surface of muzzle device 112. The muzzle device 112 can provide a threaded connection (e.g., external threads on the outer surface of muzzle device 112) with nut 306 of firearm accessory mounting device 300. Nut 306 can be rotated on muzzle device 112 to threadedly engage firearm accessory mounting device 300 to muzzle device 112. As the torque is increased to a threshold value, because the firearm accessory mounting device 300 is threadedly engaged with the muzzle device 112, nut 306 is rotated to move follower 304 (e.g., one or more followers 304) radially inward to clamp down on muzzle device 112 and/or provide a second engagement mechanism. The torque can firmly and/or securely attach firearm accessory mounting device 300 to barrel 104 and/or reinforce joint 114. Firearm accessory mounting device 300 can function similarly to active spring retention (ASR)

devices to securely reinforce joint 114 but can be operated without the conventional spring loading, thus improving the system's manufacturability, reliability, and longevity.

In various aspects, firearm accessory mounting device 300 can be constructed from a variety of materials, such as hardened plastics. E.g., Kevlar, composite fiber reinforced plastic, or other non-metallic materials can be used to construct firearm accessory mounting device 300. In various aspects, firearm accessory mounting device 300 can comprise a metallic structure. For example, one or more components (e.g., collar 302, follower 304, and/or nut 306) of firearm accessory mounting device 300 can comprise hardened steel, hardened stainless steel, and/or other metallics or stainless steels.

Figure 4:
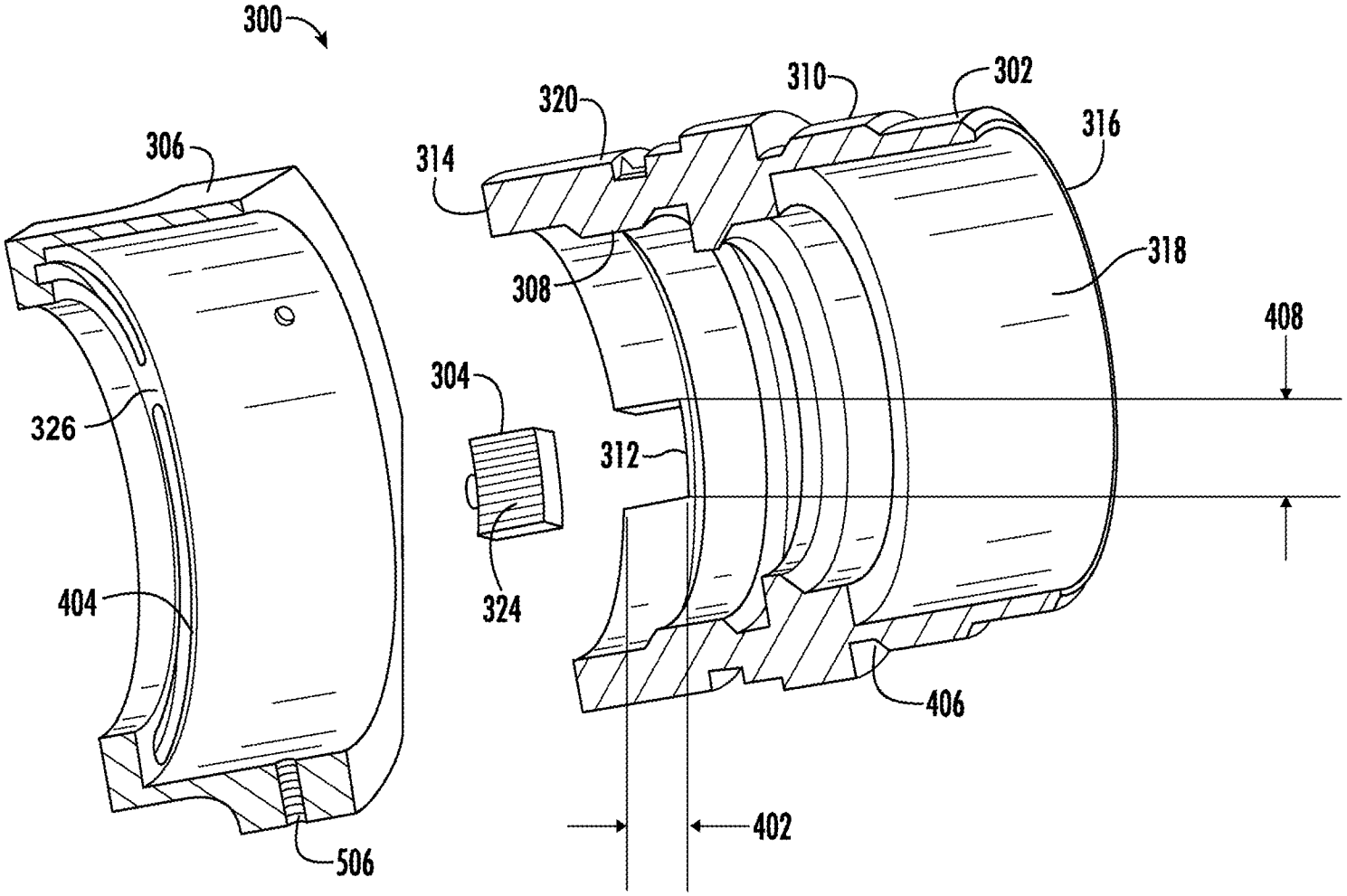
FIG. 4 is [a perspective exploded detail cross-sectional view of the firearm accessory mounting device taken along line 4-4 of FIG. 3.

FIG. 4 shows an exploded detail cross-sectional view of firearm accessory mounting device 300 taken along line 4-4 of FIG. 3. Concerning FIGS. 3 and 4, collar 302 can comprise a threaded outer surface 320 and/or muzzle device threads 308 (shown in FIG. 4) at the barrel side 206 and/or threaded outer surface or exit threads 310 of the exit side 210. An inner surface 315 of the nut 306 can rotate against the outer surface 320 of the collar 302. Muzzle device threads 308 and/or exit threads 310 are shown as as-cast, e.g., raised surfaces, and can be machined and/or milled into threads after casting and/or die-forging. Collar 302 can comprise follower recesses or inserts 312 that receive follower 304 within collar 302. A first end 314 on barrel side 206 of collar 302 can comprise inserts 312. Inserts 312 can comprise a depth 402 extending along an axial axis 110 of firearm accessory mounting device 300, e.g., that is equal to a side-length 702 of follower 304 (FIG. 7), such that when follower 304 is located or disposed within insert 312 of collar 302, a top surface 704 (FIG. 7) of follower 304 is in the same plane as the first end 314 of collar 302 at the barrel side 206. In this way, collar 302 can comprise a smooth second-end outer surface 320 that approximates a barrel 104 and/or can attach canister 212 or another device at the second-end 316. The first end 314 of collar 302 can comprise a plurality of inserts 312 configured to receive a plurality of respective followers 304 and/or create a generally smooth first end 314.

Figure 6:
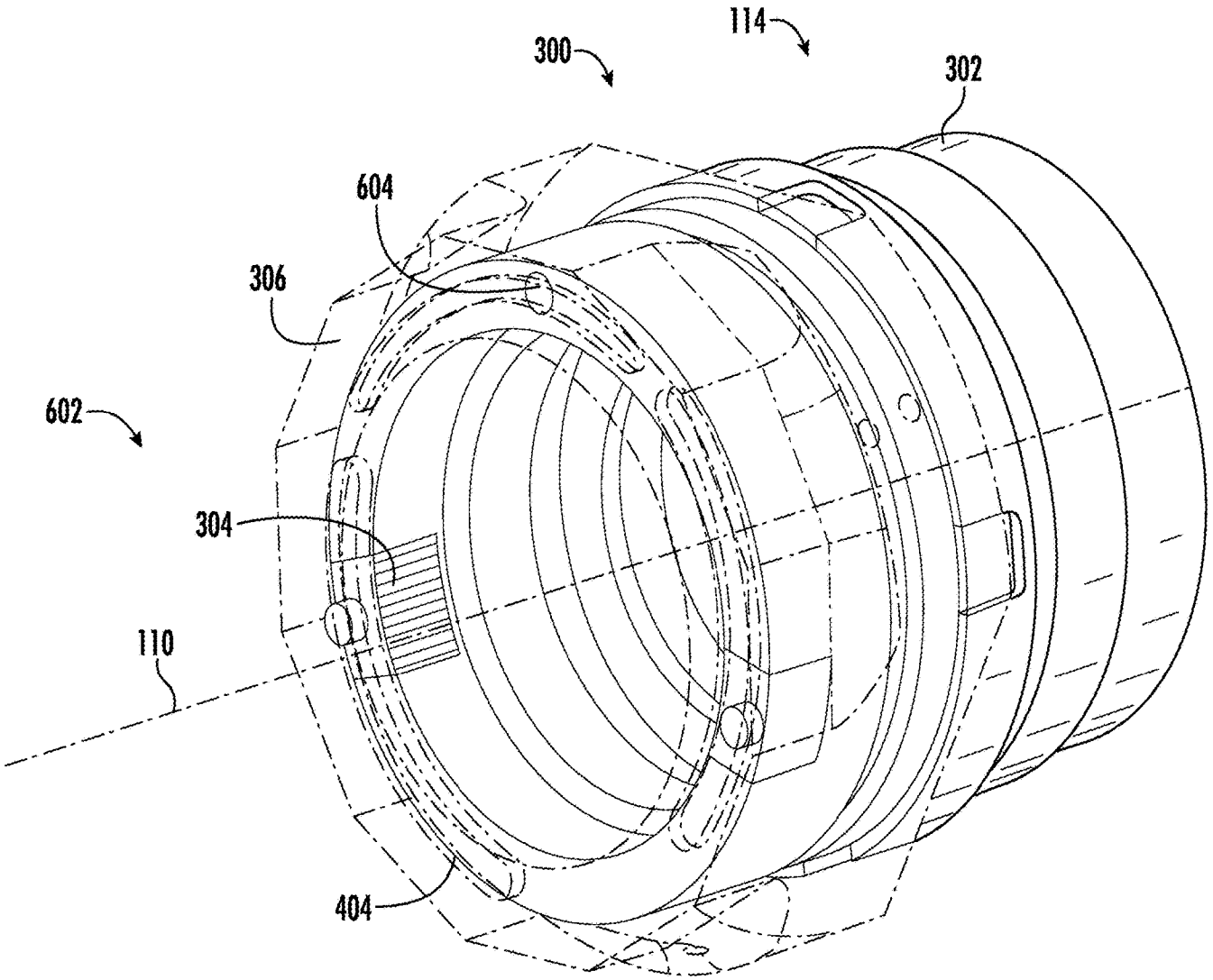
FIG. 6 is a perspective view of the firearm accessory mounting device with a transparent nut to illustrate the relationship of the follower within the nut and collar of the firearm accessory mounting device.

One or more followers 304 can be arcuate shaped and/or configured to align radially with outer surface 320 and/or inner surface 318 of collar 302. An inner surface 706 (FIG. 7) of follower 304 can be radially disposed to be the same as or similar to inner surface 318 of collar 302 when firearm accessory mounting device 300 is in an unlocked configuration 602 (FIG. 6). Follower 304 can comprise a projection, pin, or stem 708 (FIG. 7) inserted into a cam track 404 within nut 306. In this configuration, collar 302 can support a base 710 and/or two opposing sides 712*a,b* (FIG. 7) of follower 304 to partially surround follower 304. Top surface 704 of follower 304 can abut an inner transverse surface 326 of nut 306 and/or comprise stem 708 inserted into and/or following cam track 404. Cam track 404 of nut 306 can be rotated relative to collar 302, e.g., to move follower 304 radially inward (in the locked configuration 1402 of FIG. 14) and/or outwards (in the unlocked configuration 602 of FIG. 6). In various aspects, stem 708 can be partially offset such that stem 708 may not be colinear with a radius of collar 302.

In some aspects, when muzzle device threads 308 engage muzzle device 112, the inner surface 706 of follower 304 can comprise a plurality of teeth 324 (e.g., the same or similar as threads 308) to further tighten attachment assembly 100 to muzzle device 112. Teeth 324 on follower 304 can be configured to grip and/or secure firearm accessory mounting device 300 on outer surface of muzzle device 112, such that teeth 324 grip and/or expand radially inward from inner surface 318 of collar 302 to grip outer surface of muzzle device 112, and/or muzzle device 112 can be threadedly engaged with muzzle device threads 308 on the outer surface 320 of collar 302.

Figure 5:
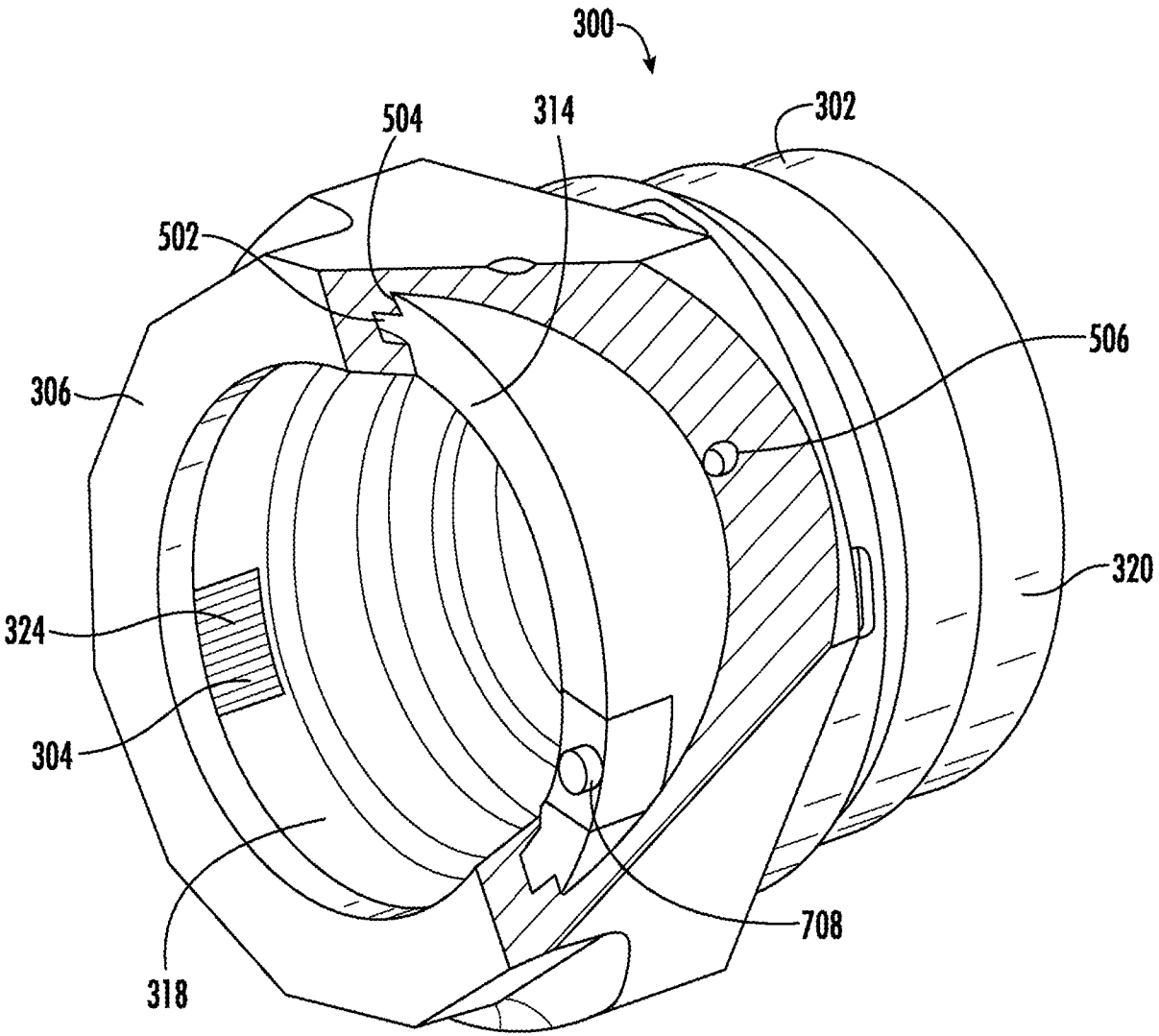
FIG. 5 is a perspective view of the firearm accessory mounting device where a portion of a nut has been removed to show a follower in a collar.

FIG. 5 shows a removed portion of nut 306 to show follower 304 in collar 302 and/or stem 708 extending from first end 314 of collar 302. FIG. 6 shows a transparent nut 306 to illustrate the relationship between follower 304 within nut 306 and collar 302. With reference to FIGS. 5 and 6, a pin 502 within a port 604 on the first end 314 of collar 302 can follow an arcuate track 504 within nut 306. Pin 502 can be rigidly supported within port 604 and/or rigidly coupled to collar 302. Pin 502 can be supported by collar 302 and/or may not be coupled to a follower 304 (e.g., with teeth 324). Arcuate track 504 may not have an angular offset such that arcuate track 504 can be concentric with inner surface 318 and/or outer surface 320 of collar 302. For example, arcuate track 504 can be compared to offset 1302, as shown in the cam tracks 404*a,b* and/or shown in FIG. 13. In this way, pin 502 and/or arcuate track 504 can facilitate the rotational adjustment of nut 306 relative to collar 302 such that one or more followers 304 may not bind and/or lock the rotational adjustment.

As nut 306 is tightened onto muzzle device 112, e.g., through rotation of nut 306, the nut 306 and/or collar 302 will threadedly fasten until a torque to continue further engagement exceeds the torque applied to cam tracks 404. Once this torque is high enough, cam tracks 404 will continue to rotate when the friction between collar 302 and/or nut 306 exceeds the friction within cam tracks 404 and/or arcuate track 504. When this happens, further rotation will cause pin 502 to follow arcuate track 504 and stem 708 will follow cam track 404, forcing follower 304 to extend teeth 324 radially inward towards axial axis 110. Thus, further rotation of nut 306 can secure nut 306 onto muzzle device 112 both through the friction generated within threads at joint 114 formed between collar 302 and nut 306 and also from the friction created between teeth 324 of followers 304 against the outer surface of muzzle device 112. This combination of friction forces in both (e.g., opposed) normal directions on muzzle device 112 may ensure a firm and/or secure attachment at joint 114.

A securing orifice 506 is also shown in the cut-out section of FIG. 5. Orifice 506 can receive a threaded fastener such as a headless screw and/or secure nut 306 to collar 302 about a radial recess 406 (FIG. 4) of collar 302. The fastener coupled to orifice 506 can facilitate rotational adjustment of nut 306 relative to collar 302, but may also restrain axial movement of nut 306 relative to collar 302 along axial axis 110.

Figure 8:
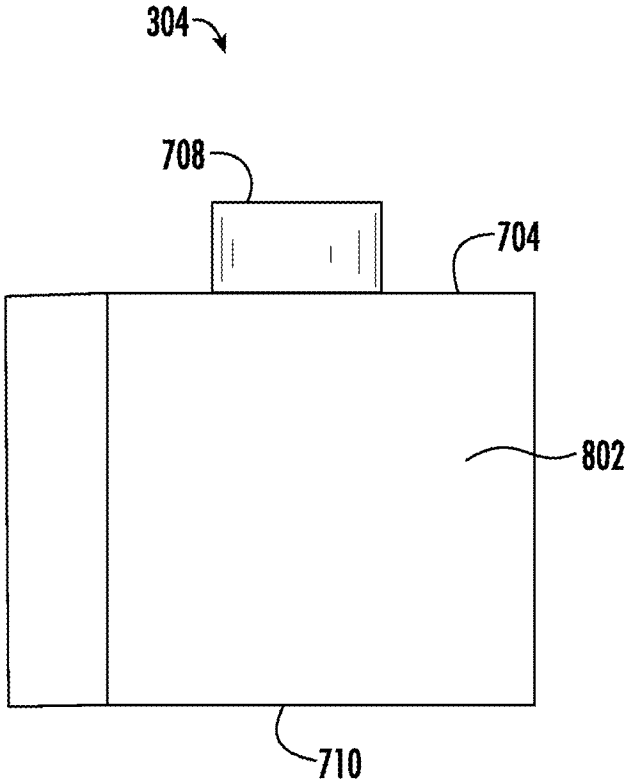
FIG. 8 is a detailed perspective view of the follower of FIG. 7 taken from the opposite side.
Figure 7:
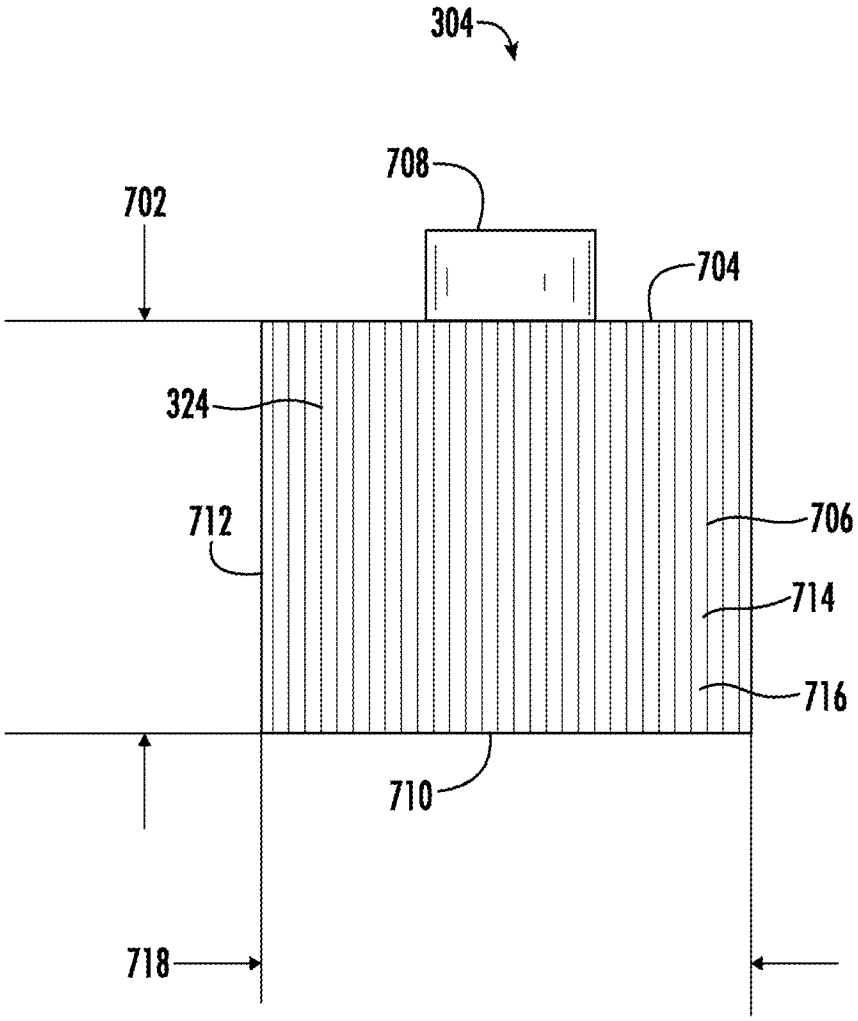
FIG. 7 is a detailed perspective view of the follower.

FIGS. 7 and 8 show opposing arcuate sides of follower 304. Specifically, FIG. 7 shows an inner arcuate side 714 with gripping teeth 716, and FIG. 8 shows a smooth outer arcuate side 802 of follower 304. Concerning FIGS. 7 and 8, two axial sides 712*a,b*, can extend on opposite sides of follower 304 and/or may be configurated to align within insert 312 of collar 302. In various aspects, a width 718 of follower 304 can be equal to or approximately the same as width 408 of insert 312. For example, base 710 of follower 304 can be arcuate and/or configured to fit within insert 312, such that top surface 704 of follower 304 can be concentric and/or axially aligned with collar 302 in the unlocked configuration 602. As described previously, stem 708 can extends from top surface 704 of follower 304 and/or can extend from first end 314 of collar 302. Stem 708 of follower 304 can be inserted within a cam track 404, e.g., within nut 306, such that rotation of nut 306 relative to collar 302 can move follower 304 radially inward (e.g., into the locked configuration 1402) to attach firearm accessory mounting device 300 quickly and securely. Similarly, rotation of nut 306 relative to collar 302 in an opposite radial direction can move follower 304 radially outward (e.g., into the unlocked configuration 602) to detach firearm accessory mounting device 300 from the muzzle or barrel 104 quickly and securely.

Figure 10:
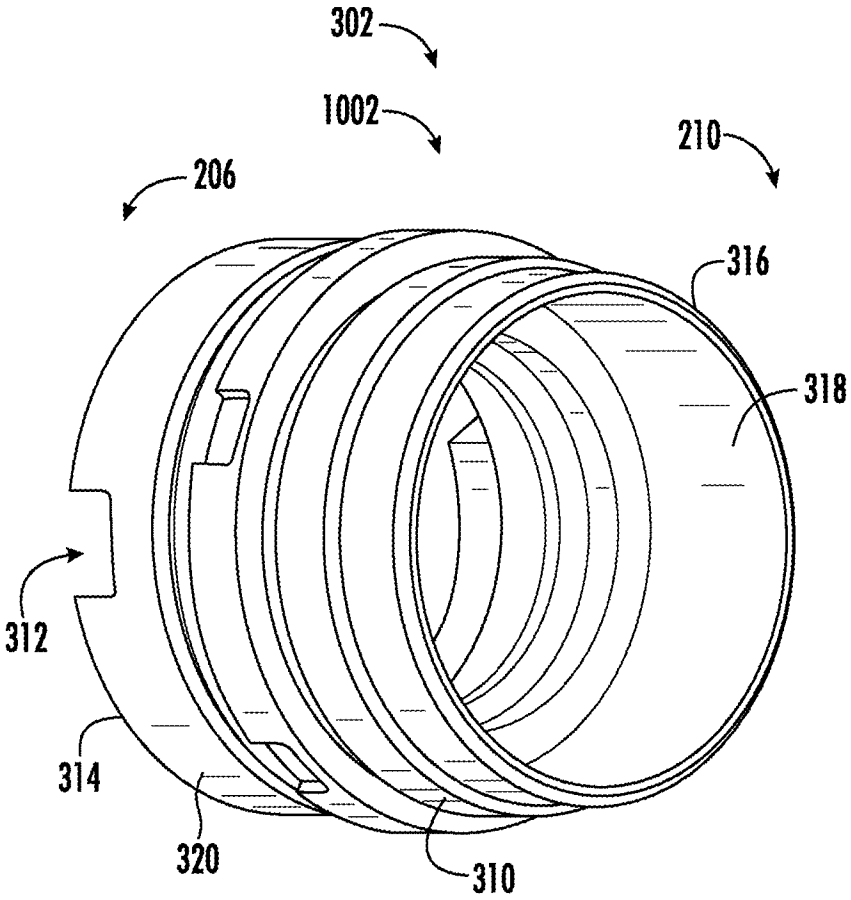
FIG. 10 is a detailed perspective view of the second side of the collar.
Figure 9:
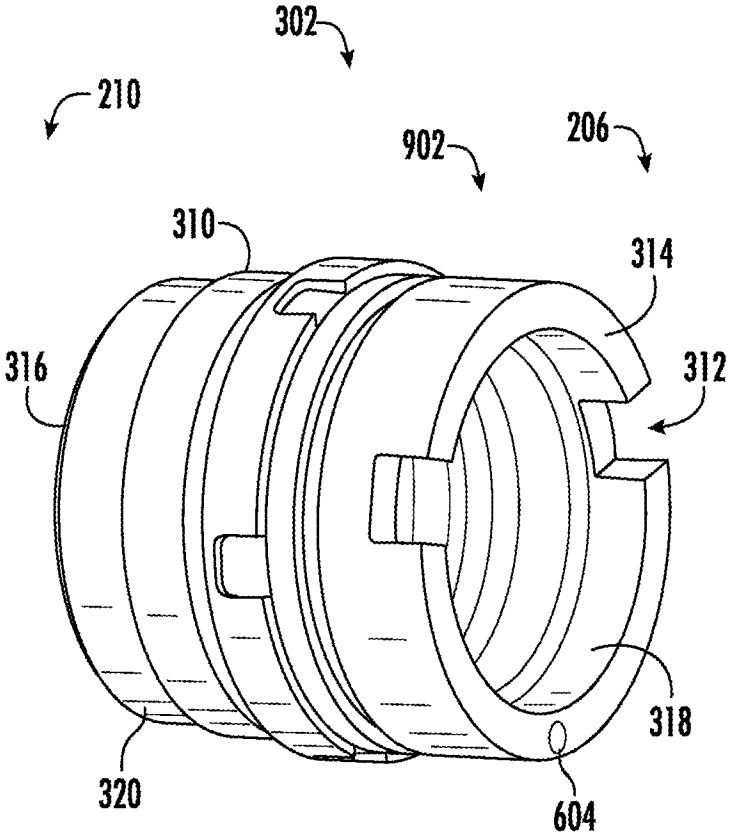
FIG. 9 is a detailed perspective view of the first side of the collar.

FIGS. 9 and 10 show contrasting perspective views of collar 302. A first side 902 has the exit side 210 opposite the barrel side 206 and oriented opposite from the second side 1002. The barrel side 206 and/or exit side 210 can be oriented in opposite directions to provide different views of various structures on collar 302. For example, two inserts 312*a,b* can receive followers 304, and radial recess 406 can extend about the exterior of collar 302. Followers 304 can have the same or similar thickness, axial geometry (e.g., such that the axial sides 712 are the same as or similar to the depth 402 of insert 312), and/or radial geometry (e.g., such that the width 718 of base 710 of follower 304 (FIG. 7) is equal to a width 408 of insert 312).

Figure 12:
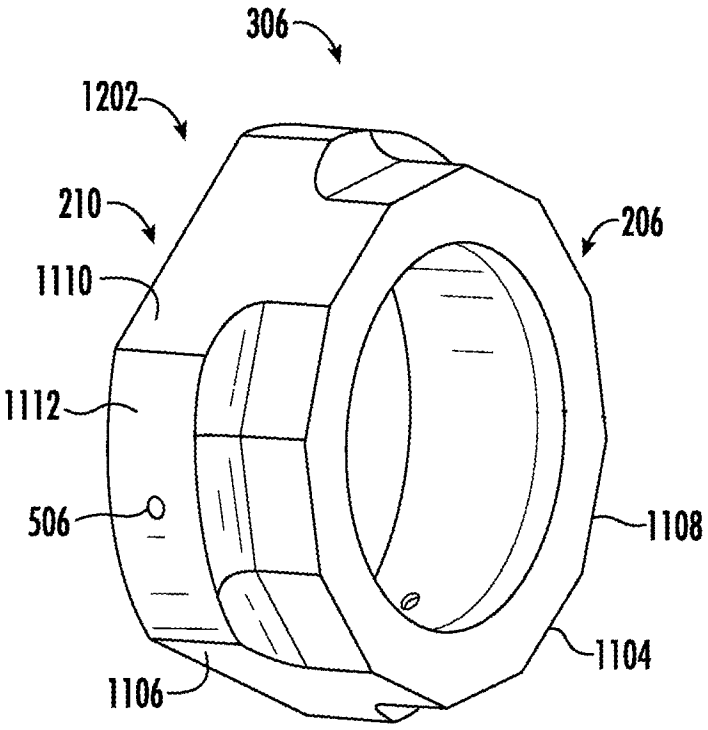
FIG. 12 is a detailed perspective view of the second side of the nut.
Figure 11:
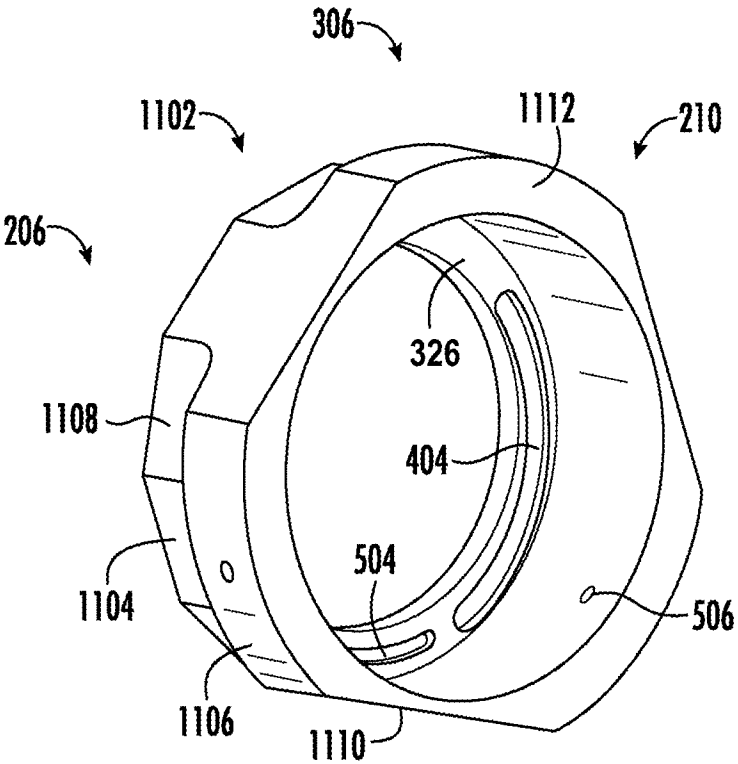
FIG. 11 is a detailed perspective view of the first side of the nut.

FIGS. 11 and 12 are different perspectives of the first side 1102 and the second side 1202 of nut 306. Nut 306 can comprise a lower linear portion 1104 on barrel side 206 of nut 306 and/or an upper portion 1106 on the exit side 210 of nut 306. The lower linear portion 1104 can comprise a plurality of planar faces 1108 oriented as angular faces about the circumference of nut 306. This configuration of planar faces 1108 can facilitate the use of a tool, e.g., a crescent wrench, to capture at least some of the planar faces 1108 and/or reduce the torque a user/operator applies, e.g., to rotate and/or fasten/tighten nut 306 onto muzzle device 112. In some aspects, a user can rotate nut 306 over the muzzle device 112 by hand, e.g., gripping upper portion 1106 of nut 306. Once the torque reaches a threshold, follower 304 can be forced radially inward to generate a clamping force on muzzle device 112. In various aspects, the entire process can be performed by hand without the assistance of a tool. Alternatively, once the torque reaches the threshold value and/or exceeds the torque available in the user's hand, a tool (e.g., wrench) can be applied to the lower linear portion 1104 to create a moment arm and/or reduce the torque the user provides to rotate and/or further fasten nut 306 onto muzzle device 112.

The upper portion 1106 of nut 306 can have a plurality (e.g., three, four, five, six, seven, eight, or more) of linear sections 1110 between a plurality of equal number arcuate sections 1112. Arcuate sections 1112 can comprise a threaded orifice 506*a,b* for a fastener to threadedly engage and/or secure nut 306 to the radial recess 406 of collar 302. For example, FIGS. 11 and 12 can comprise three arcuate sections 1112. Arcuate section 1112 can comprise an orifice 506, such that there are three orifices 506. Similarly, three linear sections 1110 can be interposed between and/or adjoining arcuate sections 1112. This is not intended to be limiting, as other numbers of linear sections 1110, arcuate sections 1112, and/or through holes (orifices 506) may be contemplated (e.g., three, four, five, six, seven, eight, or more). In some aspects, the number of linear sections 1110 is equal to or less than the number of arcuate sections 1112, and/or each arcuate section can comprise an orifice 506.

Figure 13:
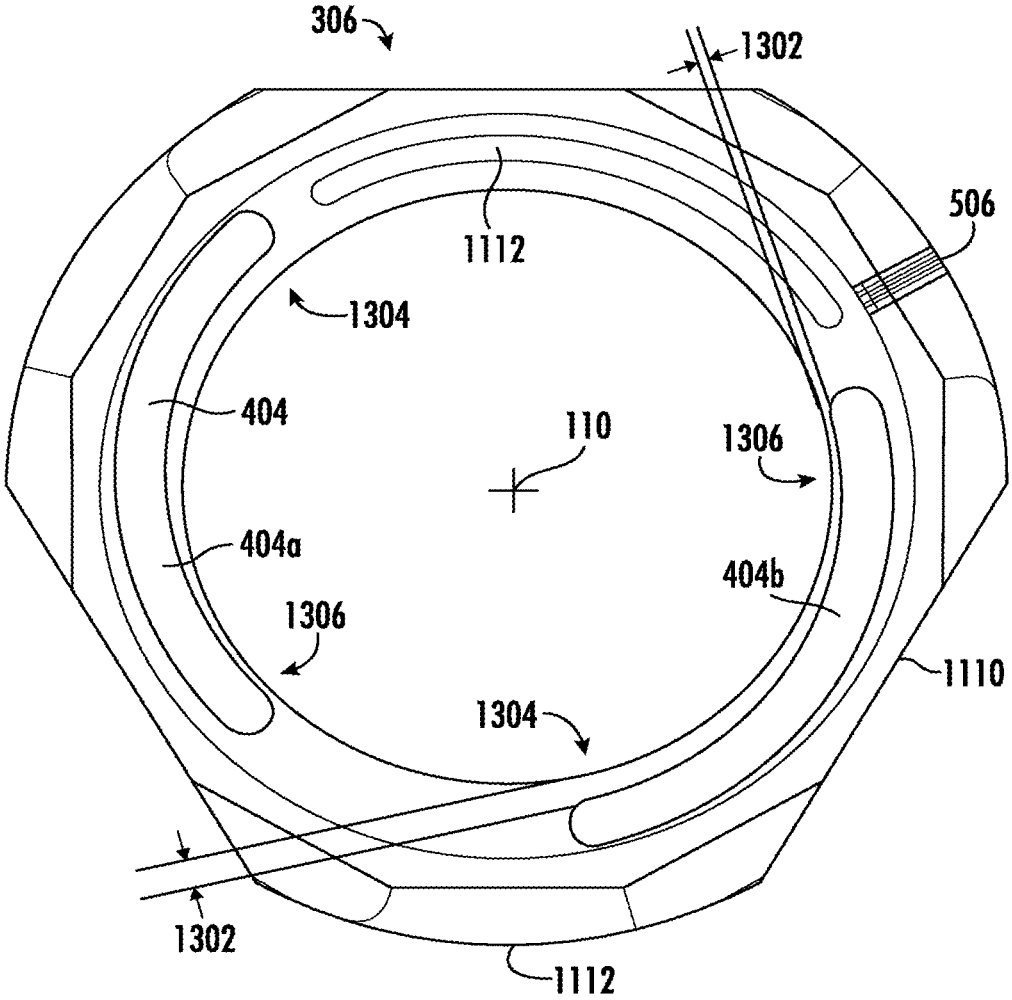
FIG. 13 is an orthogonal view of the bottom of the transparent nut to show cam tracks and a threaded orifice within the nut.

FIG. 13 is an isolated view of nut 306. Nut 306 is shown transparently to show a threaded orifice 506 extending within an arcuate section 1112 of nut 306. Cam tracks 404*a,b* are shown with a slight offset 1302. A first or unlocked portion 1304 of cam track 404 can illustrate where offset 1302 is the greatest, and followers 304*a,b* in this position will be in the unlocked configuration 602. In a second or locked portion 1306, when nut 306 is rotated, stems 708*a,b* of followers 304*a,b* may slide through cam tracks 404 towards the locked portion 1306 and/or force followers 304*a, b* radially inwards towards central axial axis 110, such that offset 1302 may be the lowest. When stem 708 and/or follower 304 is rotatably forced in, or near, the locked portion 1306, nut 306 can compress follower 304 into the locked configuration 1402.

Figure 14:
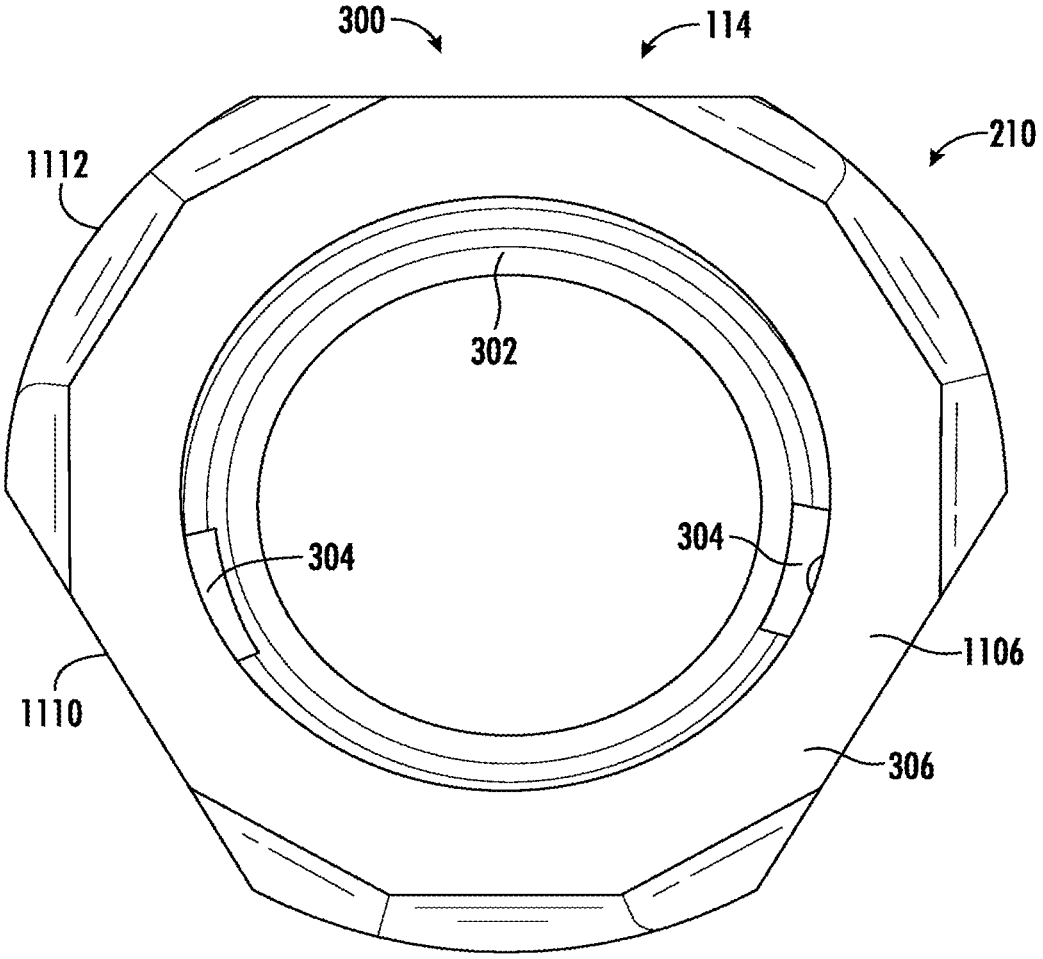
FIG. 14 is an orthogonal view of the bottom of the nut shown rotated relative to the transparent collar to show the followers in a locked configuration.

FIG. 14 shows nut 306 in a rotated position relative to transparent collar 302. When nut 306 is rotated relative to collar 302, e.g., when the friction force generated by rotating the threads reaches a threshold value, cam tracks 404 can move radially inward and/or compress against the outer surfaces of muzzle device 112. Followers 304 in FIG. 14 are shown in the locked configuration 1402.

FIG. 14 shows the arcuate sections 1112 interposed between the linear sections 1110 of the upper portion 1106 on the exit side 210 of the firearm accessory mounting device 300. Collar 302 is shown in transparent lines to demonstrate how the followers 304 clamp down on muzzle device 112 inwardly towards the inner surface of collar 302. Arcuate sections 1112 can facilitate gripping the upper portion 1106 with a user's hand to rotate the nut 306 and tighten the collar 302 against the muzzle device 112. This configuration facilitates a quick and secure system and method for attaching and detaching canister 212 from barrel 104. In other words, joint 114 between canister 212 and barrel 104 can be quickly attached/detached and/or sufficiently secure to support canister 212 under extreme conditions, including repeated firing of firearm 102.

The description is provided as an enabling teaching of the present devices, systems, and/or methods in their best, currently known aspect. To this end, those skilled in the relevant art will recognize and appreciate that many changes can be made to the various aspects described herein while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an," and "the" include plural referents unless the context clearly dictates otherwise. Thus, for example, reference to a quantity of one of a particular element can comprise two or more such elements unless the context indicates otherwise. In addition, any of the elements described herein can be a first such element, a second such element, and so forth (e.g., a first widget and a second widget, even if only a "widget" is referenced).

Ranges can be expressed herein as from "about" one particular value and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list. The phrase "at least one of A and B," as used herein, means "only A, only B, or both A and B"; while the phrase "one of A and B" means "A or B."

Unless the context clearly dictates otherwise, the term "monolithic" in the description of a component means that the component is formed as a singular component that constitutes a single material without joints or seams.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the seat nearest to and occupied by a user of a seat; "rear" is that end of the seat that is opposite or distal the front; "left" is that which is to the left of or facing left from a person sitting in the seat and facing towards the front; and "right" is that which is to the right of or facing right from that same person while sitting in the seat and facing towards the front. "Horizontal" or "horizontal orientation" describes that which is in a plane extending from left to right and aligned with the horizon. "Vertical" or "vertical orientation" describes that which is in a plane that is angled at 90 degrees to the horizontal.

One should note that conditional language, such as, among others, "can," "could," "might," or "may," unless expressly stated otherwise, or otherwise understood within the context as used, is generally intended to convey that certain aspects include, while other aspects do not include, certain features, elements and/or steps. Thus, such conditional language is not generally intended to imply that features, elements, and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

We claim:

1. A firearm accessory mounting device, comprising:

a collar extending along an axis and defining an exit side opposite a barrel side, the collar defining a first end at the barrel side thereof, an insert formed at the first end of the collar;

a nut coupled to the collar at the barrel side of the collar, the nut defining a nut barrel side and a nut exit side, an inner surface of the nut defining a nut bore extending through the nut from the nut barrel side to the nut exit side, the nut defining an annular flange extending radially inward relative to the axis at the nut barrel side, the annular flange defining a transverse surface extending radially inward relative to the axis proximate the nut barrel side and facing the nut exit side, the nut defining a cam track formed in the transverse surface; and a follower at least partially received within the insert of the collar and engaging the cam track of the nut;

wherein the first end of the collar is arranged within the nut bore and confronts the inner transverse surface of the nut; and wherein the cam track extends only partially through the annular flange.

2. The firearm accessory mounting device of claim 1, wherein the follower is a first follower and the cam track is a first cam track, the firearm accessory mounting device further comprising a second follower and a second cam track defined in the transverse surface of the nut, and wherein the collar further comprises a pin located within an arcuate track of the nut.

3. The firearm accessory mounting device of claim 1, wherein the follower is a first follower and the nut couples to the first follower and a second follower, and wherein when the nut is rotated relative to the collar from an unlocked configuration to a locked configuration in which the first follower and the second follower move radially inward relative to the axis.

4. The firearm accessory mounting device of claim 1, wherein the follower is coupled to and at least partially received within the insert at the barrel side of the collar.

5. The firearm accessory mounting device of claim 4, wherein the stem of the follower is at least partially captured by the cam track of the nut, the cam track of the nut receiving the stem and being partially offset such that the cam track is not colinear with a radius of the collar.

6. The firearm accessory mounting device of claim 1, wherein the follower is located on the barrel side of the collar and comprises a stem and teeth.

7. The firearm accessory mounting device of claim 1, wherein:

a port is defined at the first end of the collar;

a pin is at least partially received within the port; and the pin engages and follows an arcuate track within the nut.

8. A firearm, comprising:

a stock configured to be held by a user of the firearm;

an action configured to load and discharge the firearm;

a barrel configured to pressurize and eject a projectile;

a muzzle device coupled to an end of the barrel;

a firearm accessory mounting device coupled to the muzzle device, comprising:

a collar extending along an axis and defining an exit side opposite a barrel side, the collar defining a first end at the barrel side thereof, an insert formed at the first end of the collar;

a nut coupled to the collar at the barrel side of the collar, the nut defining a nut barrel side and a nut exit side, an inner surface of the nut defining a nut bore extending through the nut from the nut barrel side to the nut exit side, the nut defining an annular flange extending radially inward relative to the axis at the nut barrel side, the annular flange defining a transverse surface extending radially inward relative to the axis proximate the nut barrel side and facing the nut exit side, the nut defining a cam track formed in the transverse surface; and a follower engaging the cam track;

wherein the first end of the collar is arranged within the nut bore and confronts the inner transverse surface of the nut; and wherein the cam track extends only partially through the annular flange; and a can coupled to the firearm accessory mounting device.

9. The firearm of claim 8, wherein the nut comprises an arcuate track that receives a pin extending into the arcuate track.

10. The firearm of claim 9, wherein the pin is rigidly supported within the arcuate track and not coupled to the follower, wherein the pin is rigidly coupled to and supported by the collar.

11. The firearm of claim 8, wherein the follower is a first follower and the nut couples to the first follower and a second follower, and wherein:

the nut is rotated relative to the collar from an unlocked configuration to a locked configuration;

the first follower and the second follower extend radially inward relative to the axis; and a stem extends into the cam track of the nut.

12. The firearm of claim 11, wherein the first follower and the second follower are located on the barrel side of the collar, and the first follower and the second follower comprise the stem and teeth.

13. The firearm of claim 12, wherein the stem of the first follower is at least partially captured by the cam track of the nut, the cam track of the nut receiving the stem of the first follower and being partially offset such that the cam track is not colinear with a radius of the collar.

14. The firearm of claim 8, wherein:

a port is defined at the first end of the collar;

a pin is at least partially received within the port; and the pin engages and follows an arcuate track within the nut.

15. A method, comprising:

attaching a muzzle device to a barrel of a firearm;

attaching a firearm accessory device to the muzzle device, the firearm accessory device comprising:

a collar extending along an axis and defining an exit side opposite a barrel side, the collar defining a first end at the barrel side thereof, an insert formed at the first end of the collar;

a nut coupled to the collar at the barrel side of the collar, the nut defining a nut barrel side and a nut exit side, an inner surface of the nut defining a nut bore extending through the nut from the nut barrel side to the nut exit side, the nut defining an annular flange extending radially inward relative to the axis at the nut barrel side, the annular flange defining a transverse surface extending radially inward relative to the axis proximate the nut barrel side and facing the nut exit side, the nut defining a cam track formed in the transverse surface; and a follower engaging the cam track;

wherein the first end of the collar is arranged within the nut bore and confronts the inner transverse surface of the nut; and wherein the cam track extends only partially through the annular flange; and attaching a can to the firearm accessory device.

16. The method of claim 15, wherein:

the collar defines external threads on the exit side and at least partially captures the follower;

the cam track of the nut receives a stem; and attaching the can to the firearm accessory device further comprises threadedly rotating the can about the external threads on the collar; wherein when a torque to rotate the can reaches a threshold, the firearm accessory device rotates the collar relative to the nut to move the follower radially inward against the muzzle device.

17. The method of claim 15, wherein an arcuate track of the nut is attached to at least one pin that is not coupled to the follower.

18. The method of claim 15, wherein the can is coupled to an attachment assembly on the exit side of the firearm accessory device.

19. The method of claim 18, wherein the collar is one of a plurality of threadedly engaged collars and the can is threadedly secured to the muzzle device.

20. The method of claim 15, wherein:

a port is defined at the first end of the collar;

a pin is at least partially received within the port; and the pin engages and follows an arcuate track within the nut.

* * * * *